United States Patent [19]

Horstmann et al.

[11] 4,392,340

[45] Jul. 12, 1983

[54] YARN MONITOR FOR TWO-YARN CABLING OR TWISTING MACHINE

[75] Inventors: Aloys Horstmann, Greven; Heinz Eckholt, Münster; Reinhard Veltel, Everswinkel, all of Fed. Rep. of Germany

[73] Assignee: Volkmann GmbH & Co., Krefeld, Fed. Rep. of Germany

[21] Appl. No.: 191,024

[22] Filed: Sep. 26, 1980

[30] Foreign Application Priority Data

Sep. 28, 1979 [DE] Fed. Rep. of Germany ..... 2939435

[51] Int. Cl.[3] ..... D01H 1/24; D01H 13/16

[52] U.S. Cl. ..... 57/83; 57/78; 57/80; 57/264

[58] Field of Search ..... 57/19, 61, 62–64, 57/80, 78, 81–83, 88, 264

[56] References Cited

U.S. PATENT DOCUMENTS

| | | | |
|---|---|---|---|
| 2,930,181 | 3/1960 | Wright | 57/83 |
| 3,002,333 | 10/1961 | Wright | 57/83 |
| 3,163,977 | 1/1965 | Weiss | 57/81 X |
| 3,364,670 | 1/1968 | Stiepel et al. | 57/81 X |
| 4,075,445 | 2/1978 | Kempf | 57/81 X |
| 4,117,654 | 10/1978 | Petrov et al. | 57/80 X |
| 4,206,588 | 6/1980 | Venot | 57/80 |

*Primary Examiner*—Donald Watkins

*Attorney, Agent, or Firm*—Karl F. Ross; Herbert Dubno

[57] ABSTRACT

In a textile machine two primary yarns are fed under relatively low longitudinal tension from respective yarn supplies to a combining location at which they are combined into a single yarn. The combined yarns are fed from this location under relatively high longitudinal tension to a takeup station where they are wound up on a spool. The tension in the combined yarns is continuously monitored between the combining location and the takeup station and an output is generated when this tension drops from the high tension below a predetermined level at least equal to the relatively low tensions in the individual yarns. This occurs when one of the yarns breaks. The yarn feeds are interrupted when the output is generated to prevent forming an inadequately plied yarn.

8 Claims, 9 Drawing Figures

FIG.7
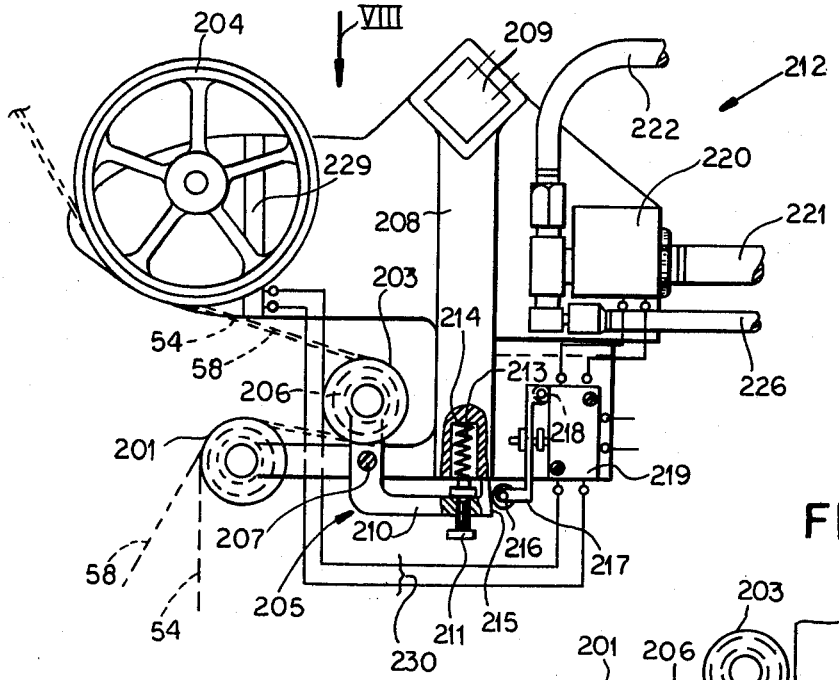
FIG.9
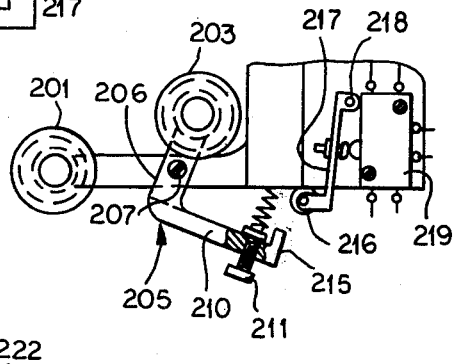
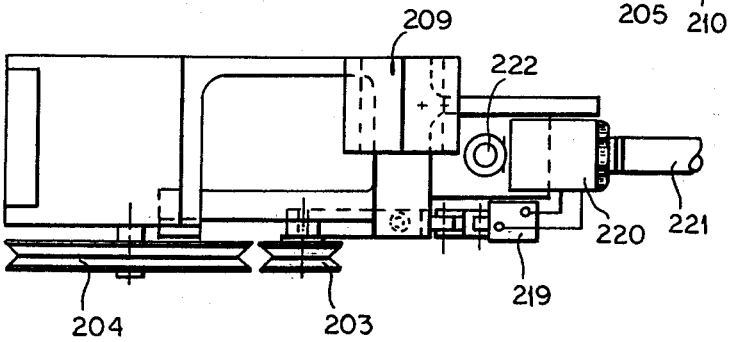
FIG.8

YARN MONITOR FOR TWO-YARN CABLING OR TWISTING MACHINE

FIELD OF THE INVENTION

The present invention relates to a two-yarn twisting or cabling machine. More particularly this invention relates to a monitor for detecting yarn breakage in such a machine.

BACKGROUND OF THE INVENTION

Two-ply yarn twisting and cabling machines are described in commonly owned U.S. Pat. Nos. 4,163,357 and 4,180,967. These machines allow two separate primary yarns to be wound into a single two-ply yarn. One or both of the yarns, in addition, may itself be twisted. Such an arrangement therefore allows a two-ply yarn to be made with two yarns wound together in, for example, a S-twist, with the yarns themselves being twisted in a Z-twist.

A particular problem with such device is yarn or thread breakage. Unlike a normal single-ply twisting machine with such an apparatus if one of the yarns breaks, the device will still continue to wind up the other yarn. In fact it is possible in such systems for one of the supplies to become depleted or one of the yarns to break and for this problem to go undetected so that a spool or yarn is supplied to a user, with the yarn being single-ply yarn instead of the desired double ply. The results of such an accident can be extremely grave in the production of high-quality textiles.

It has been suggested to provide monitoring equipment for the individual yarns. This is relatively expensive due to the fact that two yarns at least are combiined in each cabling or twisting station of such a machine, which normally includes a plurality of such cabling or twisting stations. It is almost impossible to monitor the condition of yarn being twisted by such a machine, as it normally passes directly from its supply to the center of the twister spindle, and then forms a balloon whence it is fed to the combining location. Nowhere along this path is a convenient place the yarn can be passed through appropriate sensing equipment. No other solutions of this problem have met with any success.

OBJECTS OF THE INVENTION

It is therefore an object of the present invention to provide an improved yarn monitor for a two-yarn cabling or twisting machine.

Another object is to provide such a monitor which can readily be used with the machines described in the above-cited patents.

Yet another object is to provide such a monitor which can be added to such a machine at relatively low cost, yet which will surely and positively indicate when any of the yarns being combined by the machines has broken.

Another object is to provide an improved method of operating a textile machine which automatically shuts down the machine when any of the yarns being combined by it breaks.

SUMMARY OF THE INVENTION

These objects are attained according to the instant invention by continuously monitoring the tension in the combined yarns between the location at which they are combined and the take-up station where they are normally wound up on a spool. An output is generated when the tension in these combined yarns drops from the normal relatively high tension in the combined yarns at this region below a predetermined level which is equal at least to the relatively low tension in the primary yarns downstream of the combining location. Such a tension drop normally results from breakage of one of the primary yarns or running-our of the respective supply. According to this invention the feeds of the yarns are interrupted when this output is generated.

Thus the system according to the instant invention takes the novel approach of measuring the tension of the combined yarn, and shutting down the machine when this tension drops below a predetermined level. The tension in the combined yarn is substantially greater than the tension in any of the yarns making it up, and this tension drops whenever any of the respective yarns breaks. Unlike most similar systems which operate with a single yarn and which only respond when the tension drops to zero, the system according to the instant invention detects relative tension levels and generates its output, which in fact could be constituted by opening or closing a hydraulic, electric, or pneumatic circuit, when the tension drops from a relatively high level to another level still well above zero tension. The system can be set up relatively easily to function even in systems were quite a few yarns are combined.

According to this invention the detecting means comprises a sensing element engaging the yarn in its path between the combining location and the takeup station and displaceable normally transversely in a direction transverse to this path. Means is provided such as a spring for urging the sensing element in one direction across the path, with the normal tension in the yarn inherently urging the element back in the opposite direction. This biasing force can be adjusted so that the sensing element, which according to this invention may be a two-arm lever having one arm carrying a roller engaging the combined yarn and another arm engaging a switch, will only move from a predetermined inner position to a predetermined outer position when the tension in the combined yarn drops below a predetermined level indicating that one of the filaments combined in the yarn is no longer adding its tension to that of the yarn. Such displacement from inner to outer position will either open or close the switch and shut down the yarn feeds.

The system according to the instant invention therefore also serves as an excellent monitor for shutting down the cabling or twisting machine whenever one of the yarns runs out.

According to the instant invention, therefore, means is provided for stopping the various yarn feeds whenever the sensing means generates its output. This means normally lifts the belt off the whorl of the twister while simultaneously engaging a breakshoe against the whorl and at the same time lifts the takeup spool off its drive roller. Such arresting means can advantageously be combined according to this invention with means for measuring the length of the combined yarns that passes a point along the path, this means also generating an output which can interrupt the feed of the yarns. Thus the system according to the instant invention will also shut down when a predetermined length of yarn has been wound up on the takeup spool, a much more accurate system than the prior-art which shuts the system down only when the takeup spool has attained a certain diameter.

BRIEF DESCRIPTION OF THE DRAWING

FIG. 7 is a large-scale view of a detail of the apparatus of FIG. 6;

FIG. 8 is a view taken in the direction of arrow VIII of FIG. 7; and

FIG. 9 is a view showing a detail of the apparatus of FIG. 7 in another position.

SPECIFIC DESCRIPTION

Figure 1:
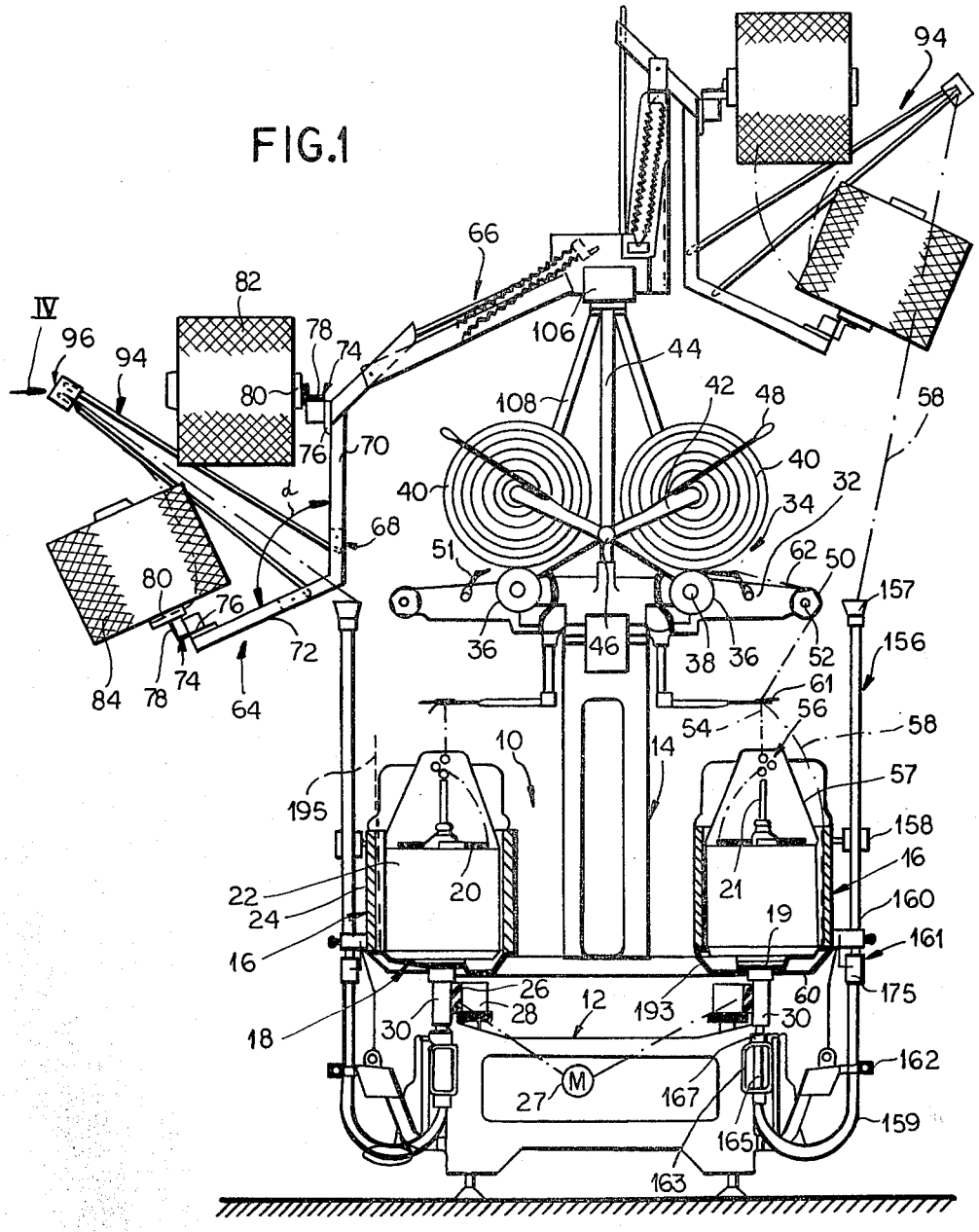
FIG. 1 is an end view of a two-yarn cabling-twisting machine suitable for the apparatus according to this invention.
Figure 6:
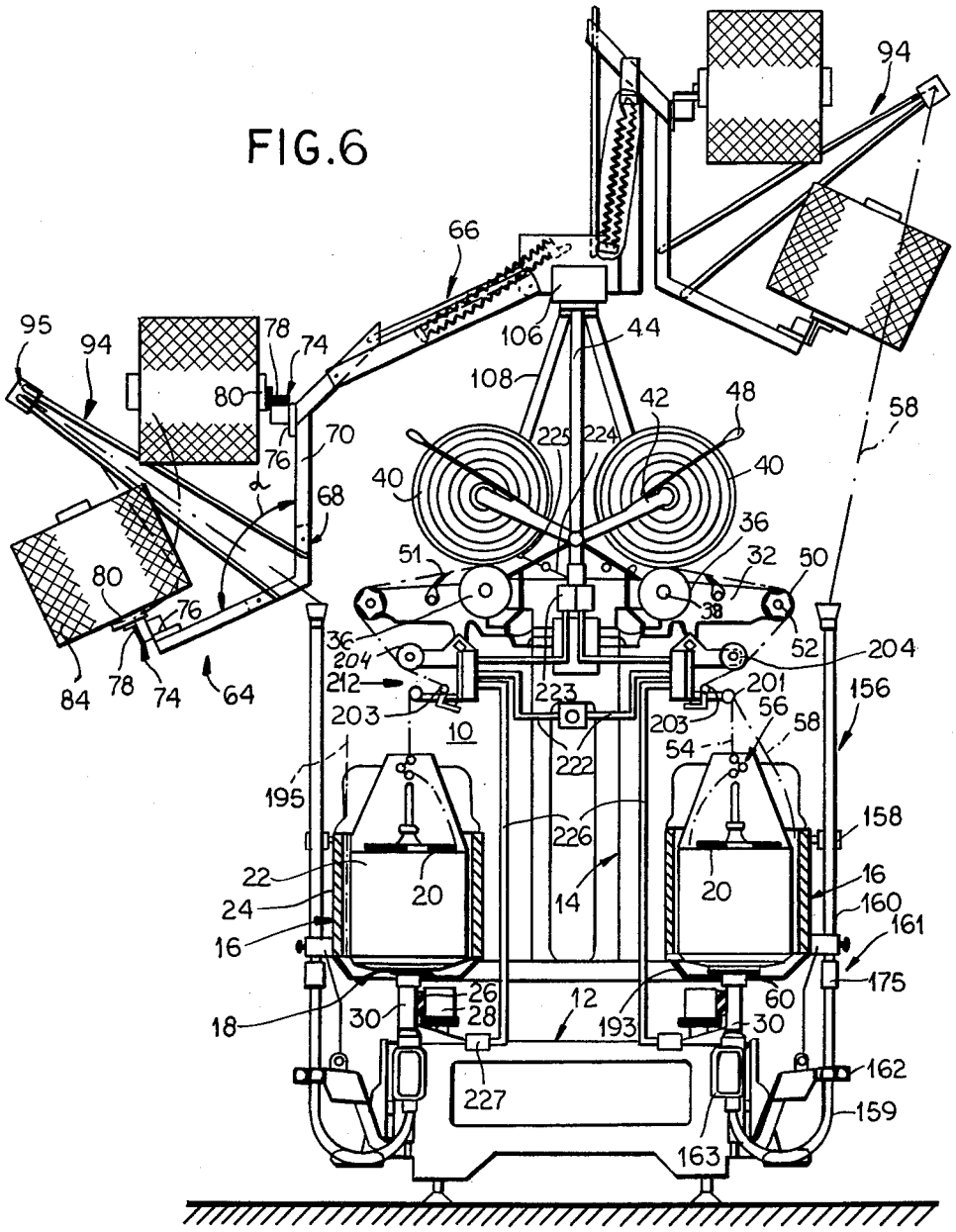
FIG. 6 is a view similar to FIG. 1 showing the apparatus incorporating the monitor according to the instant invention.

As shown in the drawing in FIGS. 1–6 the apparatus according to the invention basically comprises a frame 10 extending longitudinally in a direction perpendicular to the plane of the view in FIGS. 1 and 6 having a lower frame portion 12 and an intermediate portion 14. Two rows of twisters 16 are provided on this frame 10 at the lower frame portion 12 and immediately above each of the twisters 16 is a respective takeup device 34. Above each of the takeup devices is a respective creel or second-yarn supply 64. FIGS. 1 and 6 show two side-by-side production units each having a respective twister 16, takeup device 34, and creel 64. A gangway is provided to each longitudinal side of the frame 10.

Each twister 16 basically comprises a rotor 18 having a storage drum 60 formed with a radially open aperture 19 and by a spindle 21 supported nonrotatably on the rotor 18 and carying a yarn package 20 of a first yarn 54. Closely surrounding the yarn package 20 is an inner sleeve 22 fixed to the rotor 18 and coaxially surrounding this sleeve 22 is a balloon-limiting sleeve 24 forming an annular cylindrical space therewith. The sleeve 24 is fixed in the frame portion 12 and is therefore nonrotatable. Magnets coacting through the nonmagnetic sleeve 24 act on the sleeve 22 on the yarn package 20 and prevent it from rotating as the rotor 18 turns at high speed. A drive belt 26 operated by a motor 27 is pressed by idler rollers 28 against whorls 30 formed at the bottom 5 of the rotors 18.

A transverse beam 32 above each pair of twisters 16 supports the respective takeup devices 34. Each such device has a takeup drum 36 mounted on a shaft 38 extending parallel to the longitudinal direction of the machine and rotated at a predetermined speed by the motor 27. A takeup spool 40 is frictionally engaged by the roller or drum 38 and is carried on an arm 42 journaled at 46 on a post 44 extending upwardly from the intermediate portion 14 of the frame. A handle 48 connected to each of the arms 42 can be raised to lift the respective spool 40 off the respective continuously driven roller 38 for removal of a full spool.

In accordance with the invention the yarn 54 is pulled upwardly off the package 20 and through a three-roller thread brake 56 carried on a support 57 fixed to the inner sleeve 22 and thence through an eye 61 centered on the axis about which the rotor 18 rotates. Thence the filament 54 passes as shown in FIG. 1 directly to a deflecting roller 50 or through a yarn monitor 212 to the deflecting roller 50 which is rotatable about a horizontal arm 52. The yarn then passes through a guide eye 51 reciprocated horizontally parallel to the axis of the respective spool 40 in the manner described in U.S. Application No. 025,182, Mar. 29, 1979, now U.S. Pat. No. 4,231,531.

A second yarn 58 is combined with the yarn 54 to form a cabled doubled yarn 62. If this yarn 58 is not used the apparatus can be operated as a normal spinning machine with the yarn 54 being pulled from the pack 20, down to the spindle 21, thence out through the aperture 19 on the storage disc or drum 60, and thence up to the space between sleeves 24 and 22 to the eye 61. Indeed two packages 20 can be mounted on the spindle 21 for doubling of the yarn during twisting.

Figure 2:
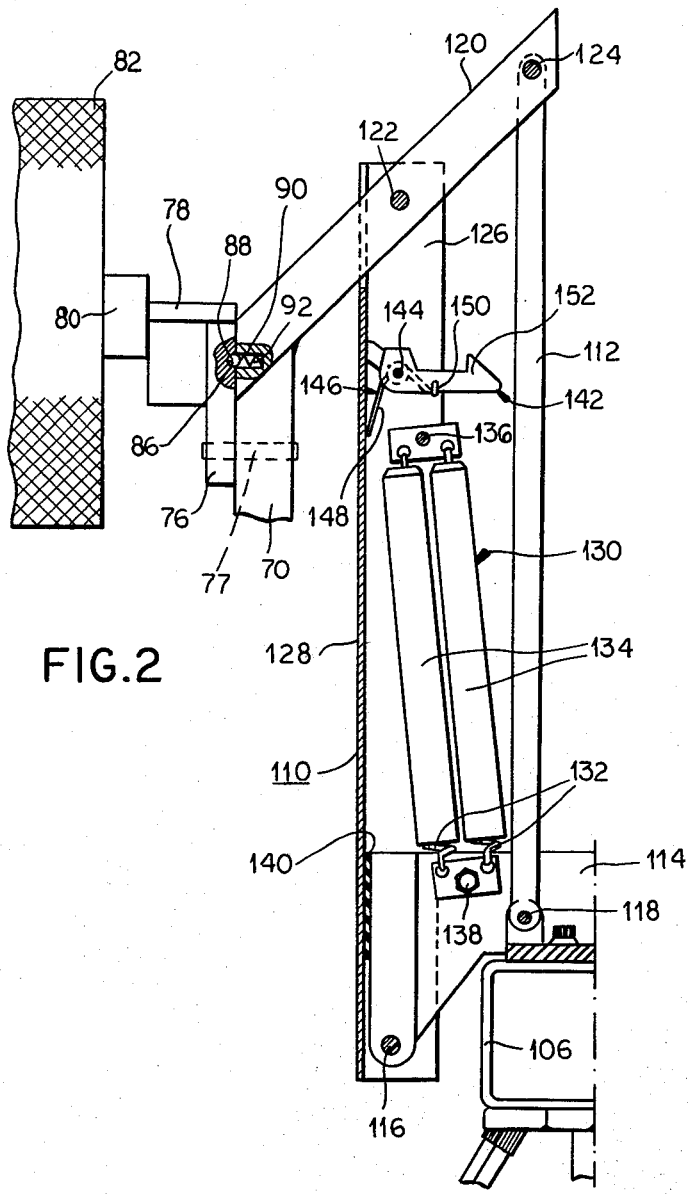
FIGS. 2 and 3 are large-scale end views of a detail of the apparatus of FIG. 1 in the operating and loading positions respectively.
Figure 3:
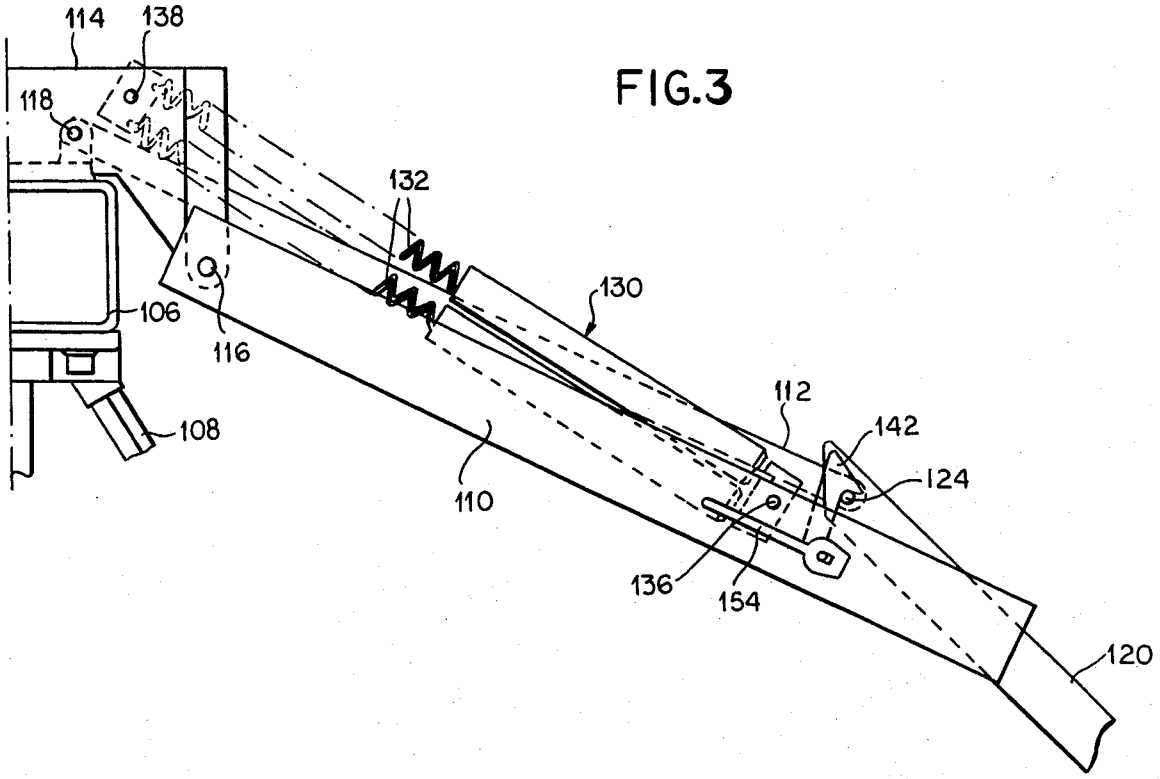
Figure 4:
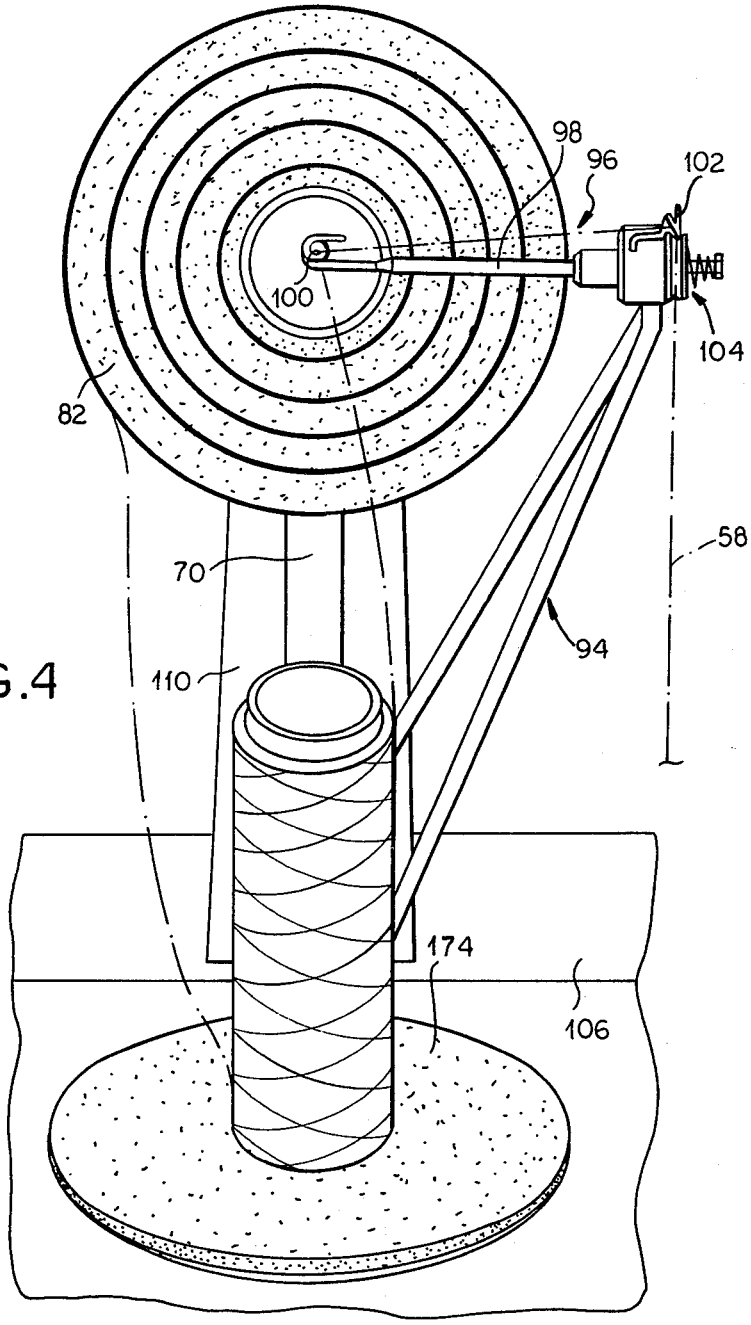
FIG. 4 is a large-scale view taken in the direction of arrow IV of FIG. 1.
Figure 5:
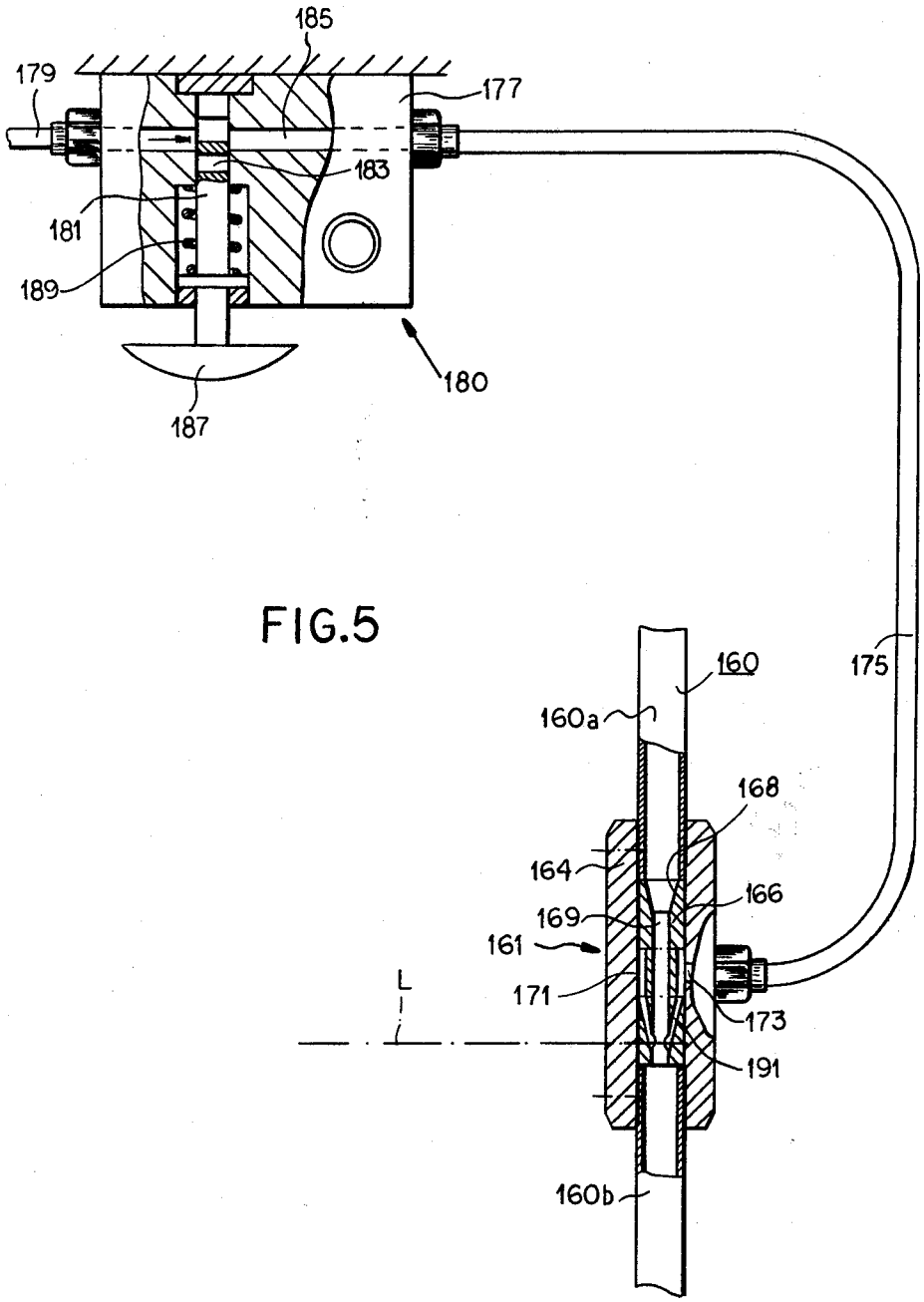
FIG. 5 is a large-scale mainly sectional view of a detail of the apparatus of FIG. 1.

As shown in FIGS. 2–4, provided above each twister 16 is the yarn holder 64 having a frame 68 and carried on a pivoting arrangement 66. The frame 68 is of V-shaped and has a pair of arms 70 and 72 each carrying a respective mount 74 on its outer end. Each mount 74 as best shown in FIG. 2 comprises a base part 76 pivotal about a pin 77 on a respective arm and having a portion 78 on which is provided a mounting pin 80 for either of two yarn packages 82 and 84. The two pins or spindles 80 extend at an angle of 120° to each other. In addition each mount 74 allows for pivoting of the respective yarn package about the axis pin 77 relative to the respective arm. A locking device in the form of semispherical recess 66 formed in the part 76 and a cylindrical recess 90 carrying a ball 88 engaged in the recess under the force of a spring 92 is provided. The two arms 70 and 72 lie in an upright plane which includes the axis of the spindle 21 of the respective twister 16.

A pair of struts 94 extend upwardly from the arms 70 and 72 and carry at their upper end a thread-guide arrangement 96 constituted by a stem 98 on the inner end of which is provided a typical thread eye or guide 100 and on the other end of which is provided another such thread guide or eye 102 and a standard spring-loaded thread brake 104. The eye 100 lies in the intersection of the axis of the pins or spindles 80 in the plane whereas the eye 102 lies outside of this plane and indeed in a plane parallel to but offset in the longitudinal direction of the machine.

At the upper end of post 44 the machine carries a longitudinal beam 106 on which are supported the inner ends of the parallelogrammatic link 66 best shown in FIGS. 2 and 3. A pair of struts 108 extending downwardly from the beam 106 make the entire upper assembly very rigid on the frame 10 of the machine.

Each parallelogrammatic linkage comprises a pair of relatively long links 110 and 112 connected together at their inner ends at respective pivots 116 and 118 on a flange or inner link member 114 fixed to the beam 106. These pivots 116 and 118 are perpendicular to vertical planes horizontally perpendicular to the longitudinal direction of the machine. At their outer ends the two links 110 and 112 are pivoted to respective pivot pins 122 and 124 on an outer arm 120 whose outer end is welded or flanged to the outer end of the one leg 70 of the V-shaped holder frame 64. The link 110 is of U-section and has a pair of parallel flanges or legs 126 in which are provided the pivot pins 116 and 122 and which flank and receive most of the structure of parallelogrammatic linkage 66 and a web 128 interconnecting these two flanges 126.

A spring assembly 130 constituted by a pair of tension springs 132 received in respective shield tubes 134, has an end plate pivoted at 136 between the flanges 126 of the link 110 adjacent pivot pin 112, and at the other end has another plate secured at 138 above the pivot pin 118 between the pivot 116 and 118 to the flange 114. This spring arrangement 130 normally biases the parallelogrammatic linkage 66 into the operating position of FIG. 2 from the loading position of FIG. 3. A bumper strip 140 is provided on the face of the flange 114 to engage the inner surface of the web 128 in the operating position so as to cushion return of the assembly to this operating position and to hold it sungly and vibrationless into place therein.

In order to lock the parallelogrammatic linkage in the loading position a hooked pawl 142 is pivoted at 144 on the link 110 at the flanges 126 thereof between the pivot pins 122 and 136. A torsion spring 146 has one leg 148 bearing on the web 128 and another leg 150 hooked over the pawl 142 to urge the hook 152 thereof over the pivot pin 124 between the links 112 and 120 in the working position. Thus once pulled down into this working position the spring-loaded pawl 142 will automatically snap over the pin 124 to hold the device in the working position. A lever 154 is fixed to the pivot pin 144 allows the pawl 142 to be swung back and unhooked from the pin 124 so that the parallelogrammatic linkage 66 can automatically return to the operating position of FIG. 2.

From the yarn guard 102 and thread brake 104 of FIG. 4 the second yarn 58 is led down through a guide arrangement 156 to the machine frame. This guide arrangement 156 if formed by a tube 160 secured by clips 158 and 162 to the machine frame and lying in the above-described filament plane. This guide tube 160 has an upstream end formed as an intake funnel 157 and a U-shaped part 159 that does not lie in the above-mentioned plane and that has another end opening upwardly in line with the axis of the respective twister 16. This tube 160 is divided at a fitting 161 into an upstream section **160*a* and a downstream section 160*b*. Fitting 161 comprises an outer sleeve 164 joining the two sections 160*a* and 160*b* and is formed with a passage 173 connected to an air-feed tube 175 connected at its other end to a valve 180**.

A pneumatic threader of the type described in commonly owned U.S. Pat. No. 4,047,372, to which reference should be made for further specifics, can blow-thread a filament through this tube 160. In this case the fitting 161 is not needed.

Provided inside the sleeve 164 between the sections **160*a* and 160*b* is a nozzle insert 166 having a central throughgoing passage 169 opening at its upstream end at a flared portion 168 and having an outwardly open groove 171 at the passage 173 and forming an annular chamber. Inclined bores 191 communicate between the chamber formed by the groove 171 and the passage 169 and are inclined inwardly and downwardly in the tube 160**.

The valve 180 has a valve housing 177 formed with a throughgoing passage 185 connected at one side to the tube 175 and at the other side to a tube 179 connected to a source of compressed air. A valve body 181 is displaceable in the housing 177 across the passage 185 and is formed with a bore 183 alignable with the passage 185. A spring 189 urges this valve body 181 into a position with the bores 183 and 185 misaligned. Depressing a knob 187 can align these bores and, therefore, feed compressed air from the line 179 to the line 175 and therethrough to the chamber 171. This compressed air will exit from the passages 191 and form above a level L at the mouths of these passages 191 a low-pressure zone.

If the button 187 is depressed and a free end of a filament 58 is dropped into the funnel 157 the low pressure will suck this filament down along the tube 160.

The other end of the tube 160 passes at 165 through the support beam 163 underneath the respective whorl 30. The tube 160, however, opens into the lower end of the spindle shaft 21 to guide the filament thus fed pneumatically into the interior of the spindle 21. This spindle 21 is provided adjacent the radially opening hole 19 with a lateral deflector so that the filament thus pneumatically entrained will automatically be blown out of this hole 19. A downwardly tapering frustoconical deflecting collar 193 is provided on the sleeve 24 so that the filament thus blown radially out of the drum 60 will be deflected upwardly to the location indicated at 195 in FIGS. 1 and 6. In this position it is a relatively simple matter for the operator of the machine to grab the filament and further thread it in the machine.

According to this invention the two filaments 54 and 58 are united at a roller 201 best seen in FIGS. 7–9. This roller 201 is fixed on a mount 208 itself secured to a longitudinally extending square-section beam 209 of the textile machine according to this invention. The two filaments 54 and 58 are combined at this roller 201. Since the yarn 58 is orbiting rapidly about the yarn 54 they will there be cabled or twisted together.

The sensing means or apparatus 212 has a sensing element constituted as a roller 203 carried on a two-arm lever 205 pivoted at 207 on the mount 208. This lever 205 has one arm 206 carrying the roller 203 and another arm 210 into which is screwed a screw 21 engaging a compression spring 213 received in a cylindrical bored 214 in the mount 208. This spring 213 urges the sensing element or roller 203 in a direction across the paths of the combined yarns 54, 58, the tension in these yarns 54 and 58 therefore urging the roller 203 in a direction opposite the biasing force of the spring 213. The end of the arm 210 is formed with a camming surface 215 engageable with a roller 216 on an arm 217 pivoted at 218 on a switch 219. This switch 219 is connected to a pneumatic valve 220 having a feed line 221 and two output lines 222 and 226. When the arm 217 of the switch 219 is allowed to swing out, that is when it is no longer engaged by the surface 215, it closes a circuit and opens the valve 220 to supply compressed air from the line 221 to the lines 222 and 226. The line 222 is connected to a respective cylinder 223 that operates an arm 224 having an end 225 constituted as a roller and engaging the respective takeup roll 40. When pressurized the cylinder 223 therefore can lift the respective spool 40 off its drive roller 36 and, therefore, stop its rotation. The line 226 is connected to a combined lift-off device and brake 227 which at the same time disengages the belt 26 from the respective whorl 30 and applies a brake to this whorl 30, thereby stopping the respective twister 16.

In addition provided downstream of the sensing roller 203 is a wheel or roller 204 connected to a counter 229 which can be set at zero, and can be set to generate an output signal identical to that of the switch 219 when a predetermined length of the combined yarns 54 and 58 has passed it. Thus when a predetermined amount of yarn has passed this wheel 204 it will generate an output that will, like the output of switch 219, shut down the respective twister and lift the respective takeup spool off its drive, thereby completely stopping the yarn feeds.

The system according to the instant invention is set to operate when the tension in the combined yarn 54, 58 drops from a relatively high level to a lower level still well above zero tension. In normal situations where two yarns are being cabled together the total tension in the combined yarn will be approximately equal to the sum of the tensions of all of the respective yarns. In situations where the yarns are just being twisted together, however, the tension will not drop drastically when one of the yarns breaks, but instead will merely drop, for example, by 30% when one of two yarns breaks. Nonetheless the system is set up so that when any such tension decrease occurs the roller 203 will move to the right in FIG. 7, pivoting clockwise, and will disengage the switch roller 216 so as to close the switch 219 and shut down the various yarn feeds. The same thing will happen when sufficient yarn has been detected by the counter wheel 204. The system according to the instant invention therefore is capable of detecting when any of the filaments being wound on the device breaks, even though it operates at a location where all of the yarns are present.

We claim:

1. A method of operating a textile machine comprising the steps of:

feeding two primary yarns under relatively low longitudinal tension from respective yarn supplies to a combining location;

combining said primary yarns at said location;

feeding the combined yarns from said location under relatively high longitudinal tension to a takeup station;

continuously monitoring the tension in said combined yarns between said location and said takeup station;

generating an output when the tension in said combined yarns drops from said high tension below a predetermined level at least equal to said relatively low tension as a result of breakage of one of said primary yarns;

interrupting the feeds of said yarns when said output is generated, said yarns being fed and longitudinally tensioned by being wound up on a takeup element at said takeup station, said yarns being combined by being wound together; and spinning one of said primary yarns about the respective supply as a balloon upstream of said location, said tension being monitored by:

passing said combined yarns over a roller forming a deflecting element between said location and station, urging said deflecting element in a direction increasing the length of the path of said combined yarns between said location and said station, and detecting the position of said element to determine the tension in said combined yarns by the release of a member acting upon said element.

2. In a textile machine wherein two primary yarns pass under relatively low tension from respective supplies to a location at which they are combined and from which they pass along a path to a takeup station under a relatively high tension, the improvement comprising:

sensor means along said path between said location and said station for detecting a decrease in the tension in the combined yarns from said high tension below a level at least equal to one of said low tensions and for generating an output when such decrease is detected; and control means connected to said sensor means and to said machine for arresting said yarns when said output is generated, said sensor means including a sensor roller engaging said combined yarns along said path and displaceable transversely of said path, biasing means urging said sensor roller transversely of said path in one direction, whereby the tension in said combined yarn in said path urges said sensor roller in the opposite direction, and an arm carrying said roller and engaged by a member which is released by said arm when said decrease is detected.

3. The improvement defined in claim 2, further comprising means for varying the force exerted in said one direction by said biasing means on said sensor element.

4. The improvement defined in claim 2 wherein said sensor element is pivotal about a fixed axis, said one direction being angular displacement in one angular direction.

5. The improvement defined in claim 2 wherein said sensor means includes a switch connected to said control means and movable between an open and closed position on displacement of said sensor element in said directions.

6. The improvement defined in claim 2 wherein said control means includes means for generating said output also when a predetermined length of said combined yarn has passed a point in said path.

7. The improvement defined in claim 2 wherein said machine includes means for winding said primary yarns together at said location.

8. The improvement defined in claim 2 wherein said machine includes means for twisting one of said primary yarns upstream of said location.

* * * * *